US005370781A

United States Patent [19]

Van de Wynckel et al.

[11] Patent Number: 5,370,781

[45] Date of Patent: Dec. 6, 1994

[54] ELECTRODE

[75] Inventors: Werner Van de Wynckel, Mortsel; Dirk de Ruijter, Deurne; Benny Jansen, Geel; Frank Michiels, Arendonk, all of

[73] Assignee: AGFA-Gevaert N. V., Mortsel

[21] Appl. No.: 194,016

[22] Filed: Feb. 9, 1994

[30] Foreign Application Priority Data

Feb. 16, 1993 [XH] Hague Agreement ..... 93200424.5

[51] Int. Cl.[5] ..... C25C 7/02; C25B 11/02

[52] U.S. Cl. ..... 204/280; 204/292; 204/293; 204/289; 429/209

[58] Field of Search ..... 204/280, 272, 292, 293, 204/281, 289; 429/209

[56] References Cited

U.S. PATENT DOCUMENTS 2,028,285 1/1936 Jephson et al. ..... 204/281
4,028,212 6/1977 Bowen et al. ..... 204/272
4,149,954 4/1979 Ransbottom ..... 204/272
4,269,690 5/1981 Graham et al. ..... 204/272
4,440,616 4/1984 Houseman ..... 204/272
5,203,979 4/1993 Üffinger et al. ..... 204/272

*Primary Examiner*—Donald R. Valentine
*Attorney, Agent, or Firm*—William J. Daniel

[57] ABSTRACT

An electrode for use in an electrolytic cell is disclosed, comprising a generally flat sheet (50) of flexible material having at least one electrically conductive surface. Upper and lower securing means are provided each comprising a tongue (55*a,b*) formed on one side edge (53) of the sheet (50) and a slot (56*a,b*) associated with an opposite side edge (54) of the sheet (50). The tongues and slots co-operate to enable the sheet (50) to be folded into and secured in an open frusto-conical configuration. This arrangement gives ease of removal from an electrolytic cell after use and advantages of requiring less storage and transport space in a flat configuration.

11 Claims, 4 Drawing Sheets

ELECTRODE

DESCRIPTION

1. Field of the Invention

This invention relates to an electrode for use in an electrolytic cell and in particular an electrolytic cell for the electrolytic recovery of silver from solutions containing silver, such as used photographic solutions such as fixing and bleach-fixing solutions.

2. Background of the Invention

An electrode for use in an electrolytic cell is known from German patent specification DE 4007906-C1 (Kodak AG) for use in the electrolytic recovery of silver from solutions containing silver. The cathode is in the form of a generally flat sheet of flexible material having at least one electrically conductive surface, in particular a graphite foil carried on a backing of polymeric material. The sheet is generally rectangular and is provided with securing means, which enable the sheet to be folded into and secured in a open cylindrical configuration. A bolt passes through an aperture in the wall of the cell and through a hole in the cathode to clamp the cathode against a contact surface associated with the wall of the cell to complete an electrical connection from the cathode to a cathode connector outside the cell.

The cathode used in electrolysis cells for the removal of silver is a replaceable item. In use, the cathode has silver deposited thereon in some quantity. It is necessary periodically to remove the cathode from the cell in order to recover the silver therefrom. By forming the cathode in cylindrical configuration the opening in the cell through which the cathode is to be removed has to be of significantly larger cross section, otherwise the is a risk that the used cathode will foul against the sides of the opening, dislodging particles of silver. These particles would eventually build up in the bottom of the cell, which would therefore require more frequent cleaning. However, if the opening through which the cathode is to be removed is significantly larger than the diameter of the cathode, it is not possible to reliably secure the cathode in the cell at the opening.

Thin electrodes are easily damaged when transported in cylindrical form. It is advantageous therefore if thin electrodes can be transported in a flat configuration, in the form of a pile of such electrodes contained within a single package, such as a cardboard box.

Furthermore, the replaceable nature of the cathode means that for optimally continuous use it is necessary for the user to keep a store of cathodes handy. With cathodes which are in an open cylindrical or otherwise bulky configuration substantial storage space is required.

It is an object of the present invention to provide an electrode which enables the aforesaid disadvantages to be overcome.

We have discovered that this and other objectives may be achieved when the electrode is provided with upper and lower pairs of securing means, enabling the sheet to be folded into and secured in an open frusto-conical configuration.

SUMMARY OF THE INVENTION

Thus according to the invention there is provided an electrode for use in an electrolytic cell, the electrode comprising a generally flat sheet of flexible material having at least one electrically conductive surface, and securing means to enable the sheet to be folded into and secured in an open circular cross-sectional configuration, characterised in that upper anti lower pairs of securing means are provided, each pair comprising a first element associated with one side edge of the sheet and a second element associated with an opposite side edge of the sheet, said first and second elements co-operating to enable the sheet to be folded into and secured in an open frusto-conical configuration.

By enabling the electrode to be folded into a frusto-conical configuration, the electrode may be utilised as a cathode in a silver recovery electrolytic cell with the larger radius end thereof secured in the opening in the cell through which the electrode is to be removed, while the tapering configuration reduces the risk of the cathode fouling the sides of that opening when it is removed. Furthermore the electrode may be stored and transported in a substantially flat configuration, with space saving advantages.

In the electrode according to the invention, the first and second elements of the upper securing means may be spaced further from each other than the first and second elements of the lower securing means. In this manner the frusto-conical folded configuration may be achieved in a simple manner.

Preferably the securing means comprise, as the first element, a tongue-shaped cut out portion provided on one side edge and, as the second element, a slot provided adjacent the opposite side edge. This arrangement enables quick and sure assembly of the electrode by location of the tongue in the slot, even by an unskilled operator. Also, this arrangement enables the electrode to be unfolded after use, leading again to storage and transportation advantages.

The distance between the first and second elements of the upper securing means preferably exceeds the distance between the first and second elements of the lower securing means resulting in a conical angle of the electrode in its folded configuration may lie between 0.5° and 2°.

In preferred embodiments of the invention, the sheet is formed of stainless steel, silver or silver alloy, non-silver containing materials being preferred from the point of view of costs, while the silver-containing materials cause fewer starting-up problems. Alternative materials include polymeric (e.g. polyester) sheet material having on one or both sides an electrically conductive coating, such as graphite. The sheet should be sufficiently thin to be flexible. We have found a sheet thickness of from 100 μm to 150 μm to be successful in the case of stainless steel and other materials of similar strength.

The sheet may be generally rectangular, wherein the top and bottom edges of the sheet are substantially parallel to each other, but concentrically curved rather than straight, so that in the frusto-conical configuration, these edges lie in planes perpendicular to the conical axis. The opposite side edges of the sheet are preferably non-parallel.

The cathode is preferably used in an electrolytic cell with its larger radius end uppermost, that is towards a circular upper opening of the electrolyte cell. This configuration enables easy removal of the cathode even after a silver deposit has built up there-on after use. The upper, larger radius of the frusto-conical cathode preferably corresponds closely to the inner radius of the upper cell opening.

In an electrolytic cell, the cathode electrical connection is of vital importance since the electrode is the basis for the cathodic reactions which are most important in a de-silvering apparatus. The electrical connection should make sure that enough current can flow to the cathode, without causing a significant ohmic voltage drop between the cathode connector and the cathode itself. To secure a low ohmic connection, we prefer that the cathode is provided with a deformable portion and that clamping means, such as in the form of a lid for the electrolytic cell, are provided to clamp the deformable portion of the cathode against an electrically conductive annular contact surface in the cell to complete an electrical connection to the cathode. The contact surface may be positioned to define an upper opening of the electrolytic cell through which the cathode may be removed. The provision of the annular contact surface in an upper part of the electrolytic cell enables this surface to be above the level of the electrolyte in the cell in use, thus reducing the risk of leakage and corrosion. By providing the annular contact surface at the opening, a large contact surface is assured, reducing the risks of a resistive connection occurring.

Thus the sheet may further comprise a deformable upper edge portion. The deformable portion of the cathode may be elastically or non-elastically deformable. We prefer that the deformable portion is comprised by a castellated upper edge of the cathode. This may be achieved by providing a number of longitudinal incisions extending from the upper edge of the cathode, defining between them a number of tongue-shaped cut out portions which can be bent outwardly by the clamping means to lie against the annular contact surface.

PREFERRED EMBODIMENTS OF THE INVENTION

The invention will now be further described, purely by way of example, by reference to the accompanying drawings in which.

Figure 1:
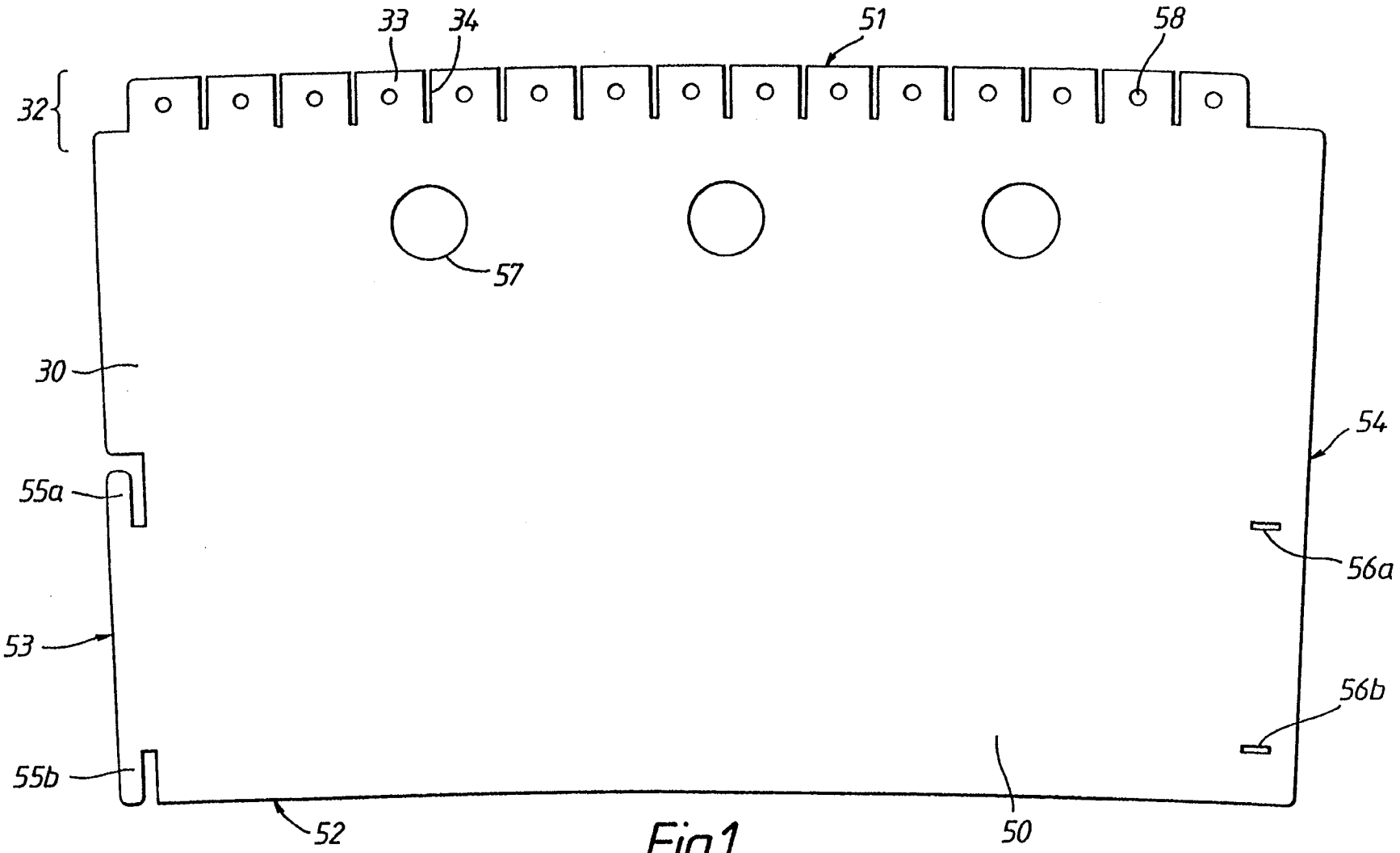
FIG. 1 is a view of a cathode according to the invention, in the flat condition.

Referring in particular to FIG. 1, an electrode 30 for use as a cathode in an electrolytic cell comprises a generally rectangular flat sheet 50 of flexible material, such a stainless steel, having a thickness of 100 μm. Both surfaces of the sheet 50 are electrically conductive. The sheet 50 has a slightly curved upper edge 51, a concentrically parallel slightly curved bottom edge 52 and two diverging opposite side edges 53, 54. Upper and lower pairs of securing means are provided each comprising a tongue-shaped cut out portion **55*a*, 55*b* formed along the side edge 53 and a slot 56*a*, 56*b* adjacent the opposite side edge 54. The elements 55*a*, 56*a* of the upper securing means are spaced further from each other than the elements 55*b*, 56*b* of the lower securing means by a factor of about 1.02. The tongue-shaped cut-out portions 55*a*, 55*b* can be fitted into the corresponding slots 56*a*, 56*b* to enable the sheet 50** to be folded into and secured in an open frusto-conical configuration, as shown in FIG. 2.

The electrode 30 has a deformable upper edge portion 32. Castellations 33 are formed at the upper edge 51 of the sheet 50 by the provision of incisions 34 extending longitudinally away from that edge. The castellations or tabs 33 together form the deformable upper edge portion 32. The sheet material of which the cathode is formed is sufficiently resilient to allow the castellations to bend outwardly in response to outwardly directed force.

Figure 2:
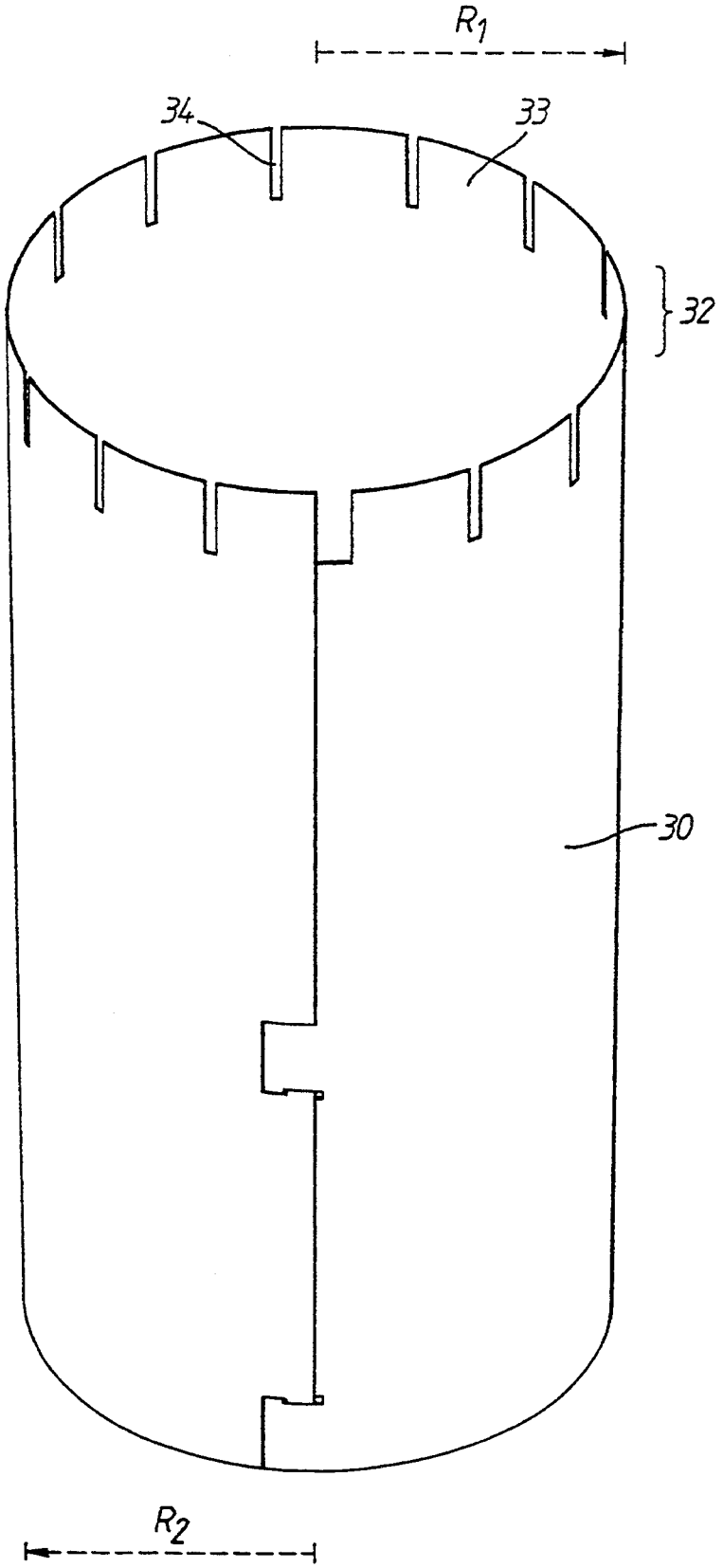
FIG. 2 is a perspective view of the cathode shown in FIG. 1; in the folded, ready for use, condition.

As can be seen from FIG. 2, the cathode 30 is folded or wrapped around into a frusto-conical configuration. The upper radius $R_1$ is marginally larger than the lower radius $R_2$ by a factor of about 1.05. The conical angle is therefore approximately 0.5°.

Figure 3:
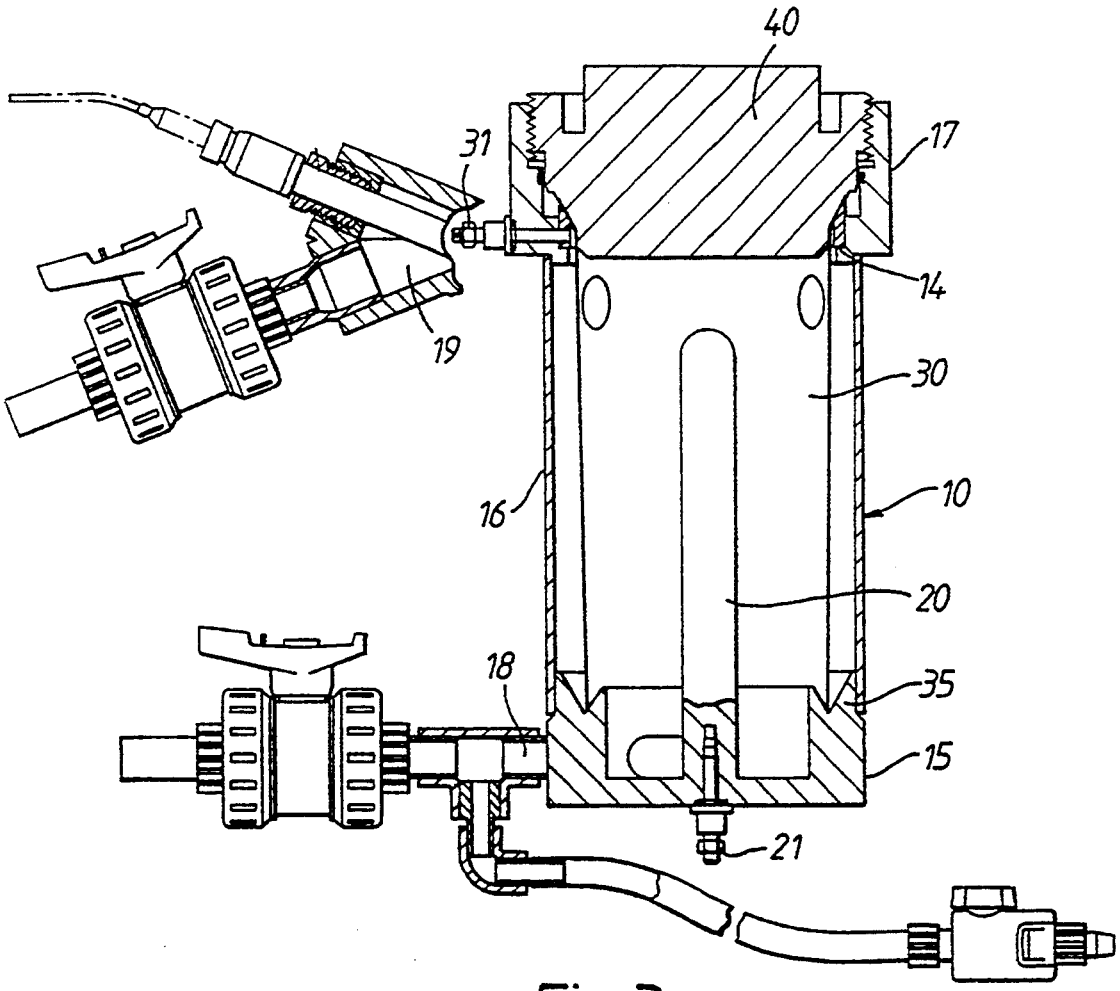
FIG. 3 shows, partly in cross-section, an apparatus incorporating a cathode according to the invention.

As shown in FIG. 3, the apparatus in which the electrode according to the invention may be employed as the cathode thereof comprises an electrolytic cell 10, formed of electrically non-conductive material such as PVC, and comprising a base 15, sides 16 and an upper portion 17. An electrolyte inlet port 18 is provided towards the bottom of the cell and an electrolyte outlet port 19 is provided towards the top of the cell. The apparatus shown in FIG. 3 forms the subject of our co-pending EP Application No. 93 200 427.8, entitled "Apparatus for the electrolytic recovery of silver", filed Feb. 16, 1993.

An anode 20, in the form of a platinised titanium rod, is secured to the base of the cell by means of a bolt 21 which acts as an electrical connector for the anode. A reference electrode 50 protrudes into the outlet port 19 of the cell.

Figure 4:
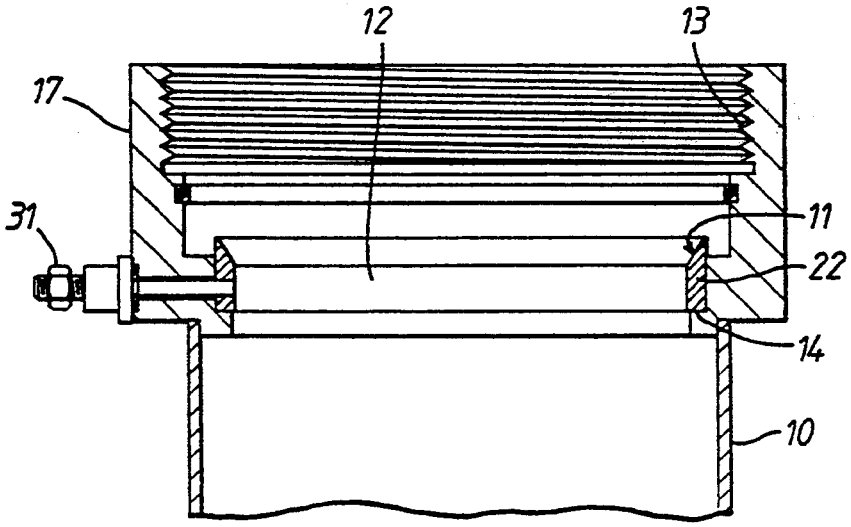
FIG. 4 shows, in cross section, the upper part of the electrolytic cell of the apparatus shown in FIG. 3.

As is shown more clearly in FIG. 4, the upper part 17 of the cell is in the form of a neck portion having an opening 12 defined by a stainless steel ring 22 having an inwardly directed annular contact surface 11. The contact surface 11 is frusto-conically shaped, having its narrower radius downwards. The stainless steel ring 22 is permanently fixed to one end of a bolt 31 which extends through the wall of the cell and provides a connector for the cathode 30. Positioned in the neck of the cell, below the level of the annular ring 22, is a sealing ring 14.

Figure 5A:
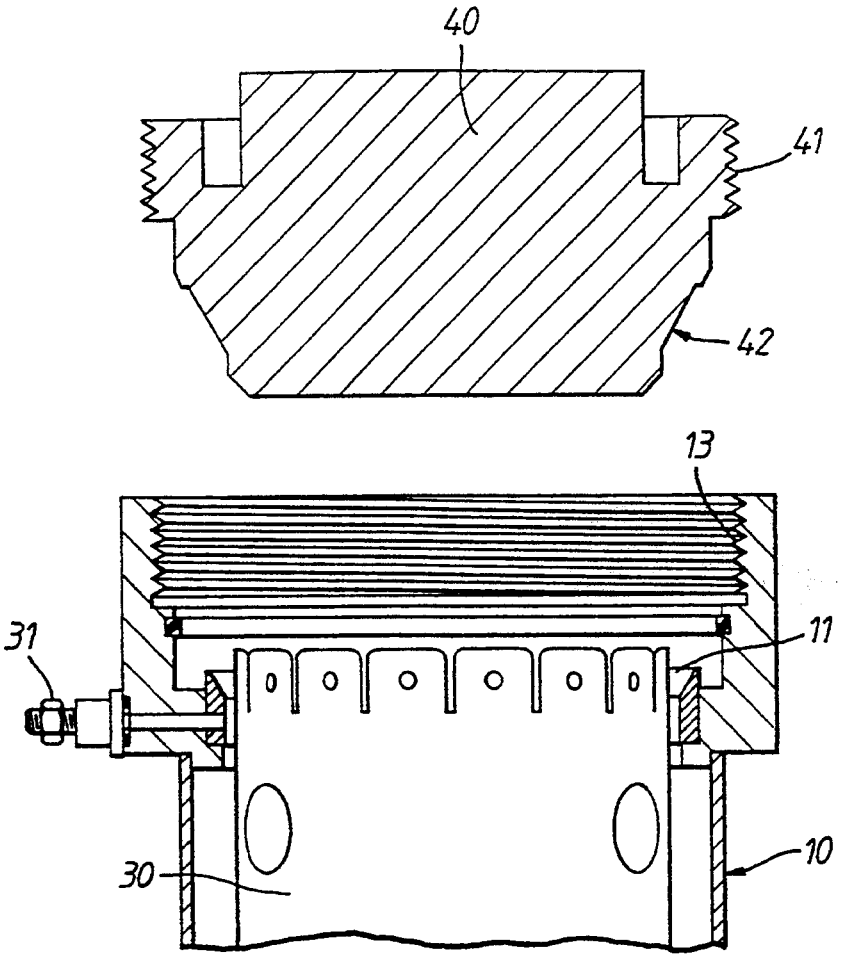
FIG. 5A is an exploded view of the upper portion of the apparatus shown in FIG. 3.
Figure 5B:
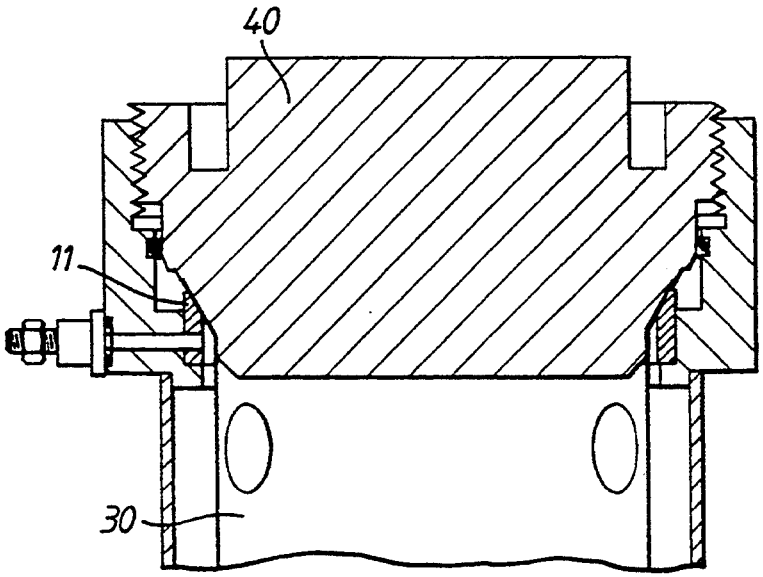
FIG. 5B corresponds to FIG. 5A, in the assembled position.

As can seen in FIGS. 3, 5A and 5B, the apparatus further comprises a lid 40 so shaped as to fit into the neck portion of the cell. The lid 40 is formed of electrically non-conductive material such as PVC. The lower portion of the lid 40 has a frusto-conically shaped clamping surface 42, shaped to correspond to the shape of the annular contact surface 11. The upper part of the lid 40 has a thread 41 which engages with a thread 13 in the neck portion of the cell.

The cathode 30 is located in the cell 10 with its bottom edge 52 supported by a cathode support ledge 35 in the cell. In this position the deformable upper edge portion 32 of the cathode lies adjacent the stainless steel ring 22. As the lid is screwed into place, by engagement of the threads 13 and 41, the frusto-conical contact surface 42 on the lid bears against the castellations 33 of the anode 30, causing these castellations to bend outwardly against the annular surface 11 of the ring 22. Tightening of the lid caused the castellations to be clamped firmly by the lid against the annular contact surface 11, thereby establishing good electrical contact therebetween.

In the closed position of the lid, the sealing ring 14 bears against the outer surface of the lid 40, thereby forming a tight seal. Electrolyte liquid is now fed into the cell by way of the inlet port 18, fills the cell and exits by way of the outlet port 19. A number of holes 57 in the cathode sheet 50 (see FIG. 1) enable the free passage of electrolyte into and out of the space defined within the cathode. The effect of the sealing ring 14 is to prevent the electrolyte level rising above the level of the outlet port 19, so maintaining an air space above the liquid and preventing contact between the liquid and the annular contact surface 11. The risk of corrosion of the latter is thereby reduced.

The cell is then operated under usual conditions, during which a silver deposit builds up on the cathode 30, primarily on the inside surface thereof. After a period of time determined by the required amount of deposited silver, the operator unscrews the lid 40 and lifts the cathode 30 out of the cell. To enable this to be done, each of the castellations 33 is provided with a hole 58 (shown only in FIG. 1) into which a retracting tool may be inserted. Due to the frusto-conical cross-section of the cathode, the sides of the cathode will not foul against the ring 22, even when some small amount of silver deposit has built up on the outside surface thereof. The silver deposit is then removed from the cathode, which may then be re-used as desired or replaced by another of similar construction for the de-silvering of a further batch of electrolyte. By forming the securing means in the form of tongue-shaped cut out portions and slots, as shown in FIG. 1, it is possible for the sheet 50 to be unfolded after use, before, during or after the removal of the silver therefrom.

We claim:

1. An electrode for use in an electrolytic cell, the electrode comprising a generally flat sheet (50) of flexible material having at least one electrically conductive surface, and securing means to enable the sheet (50) to be folded into and secured in an open circular cross-sectional configuration, characterised in that upper and lower pairs of securing means are provided, each pair comprising a first element (55*a,b*) associated with one side edge (53) of the sheet (50) and a second element (56*a,b*) associated with an opposite side edge (54) of the sheet (50), said first and second elements cooperating to enable the sheet (50) to be folded into and secured in an open frusto-conical configuration.

2. An electrode according to claim 1, wherein the first and second elements (55*a*, 56*a*) of the upper securing means are spaced further from each other than the first and second elements (55*b*,56*b*) of the lower securing means.

3. An electrode according to claim 1, wherein the securing means comprise, as the first element, a tongue-shaped cut out portion (55*a,b*) provided on one side edge (53) of the sheet (50) and, as the second element, a slot (56*a,b*) provided adjacent the opposite side edge (54) of the sheet (50) for reception of said tongue-shaped portion.

4. An electrode according to claim 1, wherein the distance between the first and second elements (55*a,b*) of the upper securing means exceeds the distance between the first and second elements (56*a,b*) of the lower securing means by a factor sufficient that the frusto-conical configuration has a conical angle of from 0.5° to 2°.

5. An electrode according to claim 1, wherein the sheet (50) is formed of stainless steel, silver or silver alloy.

6. An electrode according to claim 1, wherein the sheet (50) is generally rectangular.

7. An electrode according to claim 1, wherein the top and bottom edges (51,52) of the sheet (50) are substantially concentrically parallel to each other.

8. An electrode according to claim 1, wherein the opposite side edge (53, 54) of the sheet (50) are non-parallel.

9. An electrode according to claim 1, wherein the securing means (55,56) are releasable enabling the sheet (50) to be unfolded after use.

10. An electrode according to claim 1, further comprising a deformable upper edge portion (32).

11. An electrode according to claim 1, wherein the upper edge (51) of the sheet (50) is castellated.

* * * * *